United States Patent [19]

Yamada et al.

[11] Patent Number: 5,030,085

[45] Date of Patent: Jul. 9, 1991

[54] WICK OPERATING STRUCTURE OF LEVER ACTUATION TYPE FOR OIL BURNER

[75] Inventors: Toshihiko Yamada; Yutaka Nakanishi; Shozou Asano, all of Aichi, Japan

[73] Assignee: Toyotomi Kogyo Co., Ltd., Aichi, Japan

[21] Appl. No.: 385,125

[22] Filed: Jul. 26, 1989

[30] Foreign Application Priority Data

Jul. 29, 1988 [JP] Japan ..... 63-101973
Jul. 29, 1988 [JP] Japan ..... 63-101974

[51] Int. Cl.[5] ..... F23N 5/24

[52] U.S. Cl. ..... 431/88; 431/33; 431/304; 126/92 AC; 126/96; 169/54

[58] Field of Search ..... 431/88, 15, 33, 34, 431/304, 307; 169/49, 60, 69, 54; 126/92 AC, 96, 45

[56] References Cited

U.S. PATENT DOCUMENTS 4,457,698 7/1984 Shibata et al. ..... 431/88 X
4,486,170 12/1984 Tsukada et al. ..... 431/88 X
4,591,000 5/1986 Nakamura et al. ..... 431/88 X
4,726,762 2/1988 Nakamura et al. ..... 431/88
4,740,153 4/1988 Nakamura et al. ..... 431/88 X

FOREIGN PATENT DOCUMENTS 34124 3/1980 Japan .
26701 6/1980 Japan .
33369 9/1986 Japan .

*Primary Examiner*—Larry Jones
*Attorney, Agent, or Firm*—Pollock, Vande Sande & Priddy

[57] ABSTRACT

A wick operating structure of the lever actuation type for an oil burner capable of finely adjusting the combustion with high accuracy during the combustion operation. The structure includes an operation lever for rotating a wick operating shaft which is provided with a drive pin and a plurality of drive levers pivotally moved independent from one another so as to be accessible to the drive pin. The drive levers are formed with a V-shaped recesses which are different in configuration from one another little by little and in which the drive pin is alternatively fitted to cause the operation lever to be pivotally moved to different positions little by little.

37 Claims, 7 Drawing Sheets

WICK OPERATING STRUCTURE OF LEVER ACTUATION TYPE FOR OIL BURNER

BACKGROUND OF THE INVENTION

This invention relates to a wick operating structure of the lever actuation type for an oil burner, and more particularly to a wick operating structure for an oil burner which is adapted to vertically move a wick for the combustion and fire-extinguishing by means of an operation lever.

Recently, a wick operating structure of the lever actuation type has been widely used for an oil burner of the wick ignition type in place of a wick operating structure of the dial actuation type, because it permits a wick to be vertically moved by a simple or one-tough operation although an angle by which a wick operating shaft actuated by an operation lever is rotated is set within a small range, so that it is required to manufacture its parts with high precision. A typical wick operating structure of this type which has been conventionally used is disclosed in U.S. Pat. No. 4,726,762 issued to Nakamura et al on Feb. 23, 1988 and assigned to the assignee.

In the conventional wick operating structure which is adapted to vertically move a wick by a one-touch operation as described above is so constructed that the movement of the operation lever by a small distance causes the wick to be vertically moved in a large amount, resulting in even the movement of the lever in a small amount leading to a substantial variation in combustion. Thus, the conventional structure fails to finely adjust the combustion operation. Fortunately, this does not substantially cause a significant problem in a combustion cylinder construction employed in an old-fashioned oil burner of the wick ignition type because it is not constructed so as to carry out the adjustment of the combustion. However, it has been widely recognized in the art that this causes an important problem in an up-to-date combustion cylinder construction which is constructed so as to permit the combustion to be adjusted as desired and which has been extensively substituted for the above-described combustion cylinder construction.

Also, the conventional wick operating structure of the lever actuation type is simplified in mechanism and lightly actuated as compared with the dial-actuation-type structure, because the former merely requires to move the operation lever in a vertical direction which is a direction of movement of a wick in contrast with the fact that the latter requires a complicated mechanism for converting the rotation of a dial into the linear movement of a wick. Unfortunately, the simplification and light actuation of the structure often cause the vertical position of the wick to be readily varied due to vibration or shock applied thereto, leading to danger such as abnormal combustion or the like.

In general, a wick used in a conventional oil is covered at a tip end thereof with tar or the like and/or deteriorated by heat. Also, the wick fails to satisfactorily suck up fuel oil due to sucking-up of contaminants such as water contained in the fuel oil and the like. Thus, the wick fails to satisfactorily exhibit its function of vaporizing fuel oil at a level or vertical position predetermined for the desired combustion, leading to a decrease in combustion, so that the vertical position of the wick predetermined for the minimum combustion results in abnormal combustion which produces soot and incomplete combustion gas.

Accordingly, when a wick is deteriorated, it is required to replace the deteriorated wick with a fresh wick or vary the vertical position of the deteriorated wick depending on a degree of the deterioration to ensure the desired combustion. However, this is highly troublesome in the wick operating structure of the lever actuation type, as compared with that of the dial actuation type wherein the vertical position of a deteriorated wick is adjusted from the outside of an oil burner without disassembling the oil burner as disclosed in Japanese Utility Model Publication No. 33369/1986, which was put to practice by the assignee.

More particularly, a system employed in the structure of the dial actuation type is not applied to the structure of the lever actuation type because the wick operating structure of the lever actuation type lacks a gear mechanism as employed in that of the dial actuation type. Also, the structure of the lever actuation type, as described above, has a disadvantage that an angle at which the wick operating shaft actuated by the operation lever is rotated is set within a small range. Thus, in the wick operating structure of the operation lever actuation type, it is substantially impossible to vary or adjust the vertical position or height of the wick from the exterior of the oil burner.

Further, a conventional oil burner which employs the wick operating structure of the lever actuation type described above generally includes an automatic fire-extinguishing device. The device includes a drive plate to which a return spring is connected and which is operatively connected to the operation lever and is provided with a retaining portion normally engaged with a stopper operatively connected to a vibration sensing weight to keep the drive plate stationary. In the so-constructed automatic fire-extinguishing device, the retaining portion is released from the stopper when the vibration sensing weight falls down or tilts due to vibration or shock applied thereto and then the return spring actuates the drive plate to move the wick operating shaft to the fire-extinguishing position through the operation lever. The vibration sensing weight falling down due to vibration can right itself immediately, when it has a low center of gravity. However, when the vibration sensing weight has a high center of gravity, it is held tilted, resulting in a reset lever manually operated for resetting the vibration sensing weight being required as disclosed in Japanese Utility Model Publication No. 26701/1980. Alternatively, such a reset lever may be automatically actuated by the wick operating shaft at the fire-extinguishing position to reset the vibration sensing weight as suggested in Japanese Utility Model Application Laying-Open Publication No. 34124/1980.

In the vibration sensing weight of which a center of gravity is defined at a low level to cause the weight to right itself, it is required to reduce an angle by which the vibration sensing weight is pivotally moved. Unfortunately, this reduces a distance of movement of an actuation plate of the vibration sensing weight which functions to push up the stopper when the weight falls down, to a degree sufficient to cause malfunction of the automatic fire-extinguishing device. On the contrary, the vibration sensing weight adapted to be kept at a fallingdown state when it falls down causes a distance by which the actuation plate is moved to be substantially increased. Although this ensures the positive operation of the automatic fire-extinguishing device, it is required to arrange the reset lever for resetting the weight, resulting in the handling of the oil burner being troublesome and the construction of the oil burner being highly complicated. In addition, in the device disclosed in Japanese Utility Model Application Laying-Open Publication No. 34124/1980, the wick operating shaft is provided with a projection at a position suitable for being operatively connected to the reset lever, resulting in the reset lever being operated at the fire-extinguishing position. Such construction improves the operability of the reset lever, however, it often fails to operate the reset lever during the wick lowering operation in the case that the wick operating shaft is adapted to be rotated over an angle exceeding 360 degrees, resulting in a failure in the wick lowering operation. Also, when an angle of rotation of the wick operating shaft is set within a small range, the construction not only renders the accurate movement of the reset lever to the fire-extinguishing position highly difficult but causes the misoperation of the reset lever before the wick is fully lowered to the fire-extinguishing position to lead to the resetting of the vibration sensing weight, resulting in undesired variations in fire-extinguishing time. Unfortunately, there is not found any means which is capable of solving such a problem with a simplified structure.

SUMMARY OF THE INVENTION

The present invention has been made in view of the foregoing disadvantages of the prior art.

Accordingly, it is an object of the present invention to provide a wick operating structure of the lever actuation type for an oil burner which is capable of finely adjusting the combustion with high accuracy.

It is another object of the present invention to provide a wick operating structure of the lever actuation type for an oil burner which is capable of rapidly varying the amount of combustion as desired by a simple or one-touch operation.

It is a further object of the present invention to provide a wick operating structure of the lever actuation type for an oil burner which is capable of effectively preventing the malfunction or undesired movement of an operation lever due to shock or vibration applied thereto during the combustion operation to prevent a variation in combustion of the oil burner.

It is still another object of the present invention to provide a wick operating structure of the lever actuation type for an oil burner which is capable of adjusting the amount of combustion while keeping the normal combustion.

It is yet another object of the present invention to provide a wick operating structure of the lever actuation type for an oil burner which is capable of permitting a user to be aware of the excessive lowering of an operation lever in a wick lowering operation.

It is even another object of the present invention to provide a wick operating structure of the lever actuation type for an oil burner which is capable of adjustably varying the vertical position or height of a wick from the exterior of an oil burner as desired.

It is still a further object of the present invention to provide a wick operating structure of the lever actuation type for an oil burner which is capable of being highly improved in handling.

It is yet a further object of the present invention to provide a wick operating structure of the lever actuation type for an oil burner which is capable of carrying out the fire-extinguishing operation while keeping the vertical position of a wick at a predetermined level, resulting in substantially preventing time required for the fire-extinguishing operation from being varied.

It is an even further object of the present invention to provide a wick operating structure of the lever actuation type for an oil burner which is capable of stably accomplishing the fire-extinguishing operation.

It is another object of the present invention to provide a wick operating structure of the lever actuation type for an oil burner which is capable of positively carrying out the resetting of a vibration sensing weight without any malfunction.

It is another object of the present invention to provide a wick operating structure of the lever actuation type for an oil burner which is capable of carrying out the positive operation and resetting of an automatic fire-extinguishing device.

In accordance with the present invention, a wick operating structure of the lever actuation type for an oil burner is provided. The structure includes a wick operating shaft operatively connected to a wick and rotatably arranged for vertically moving the wick due to its rotation and an operation lever fitted thereon for rotating the wick operating shaft. The operation lever is provided with a drive pin. The structure also includes a plurality of drive levers arranged in a manner to be pivotally moved independent from one another about a common support shaft therefor so as to be accessible to the drive pin of the operation lever. The drive levers each are provided with a V-shaped recess at a portion thereof opposite to the drive pin of the operation lever pivotally moved to a wick raised position. The V-shaped recesses of the drive levers are formed into configurations different from one another little by little to a degree sufficient to permit the operation lever to be pivotally moved little by little through alternate engagement of the drive pin with the V-shaped recesses of the drive levers to vary the vertical position of the wick little by little during the combustion operation.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a wick operating structure according to the present invention will be described hereinafter with reference to the accompanying drawings.

Figure 1:
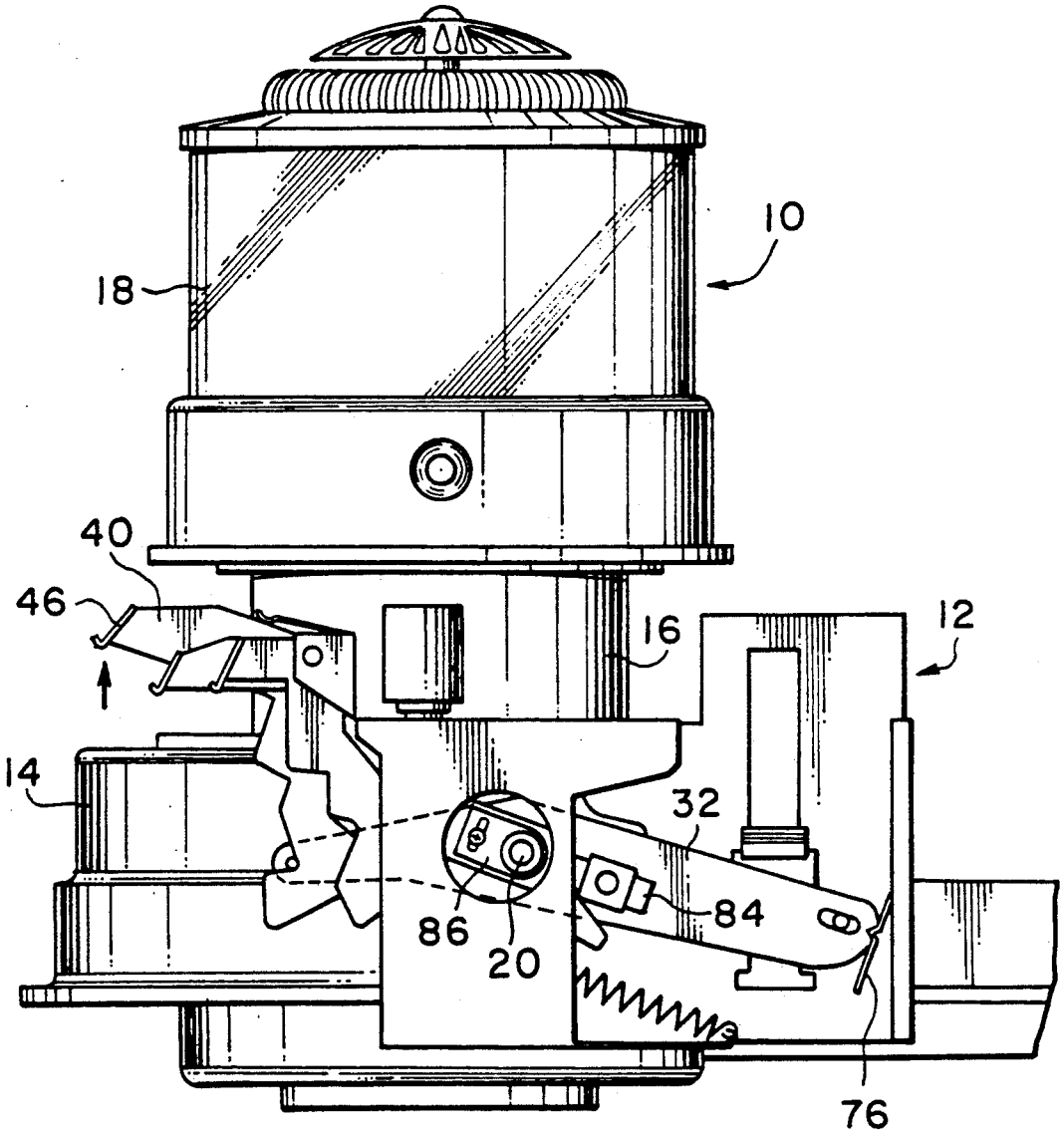
FIG. 1 is a front elevation view showing an example of an oil burner in which a wick operating structure of the lever actuation type according to the present invention is adapter to be incorporated.

FIG. 1 illustrates an example of a wick ignition type oil burner in which a wick operating structure of the lever actuation type according to the present invention is adapted to be incorporated. In FIG. 1, an oil burner and an embodiment of a wick operating structure according to the present invention are generally designated by reference numerals 10 and 12, respectively. The oil burner 10 is in the form of a space heater, however, it should be noted that an oil burner to which the present invention is to be applied is not limited to such a space heater.

The oil burner 10 per se may be constructed in such a manner as widely known in the art. The oil burner 10, as shown in FIG. 1, generally includes an oil reservoir 14 for storing fuel oil such as kerosene therein, a wick receiving cylinder 16 positioned on the oil reservoir 14 and a combustion cylinder construction 18 supported on the wick receiving cylinder 16, each of which may be constructed in a manner as known in the art. The wick operating structure 12 is arranged in proximity to the wick receiving cylinder 16.

The wick operating structure of the illustrated embodiment will be described hereinafter in detail with reference to FIGS. 1 to 4.

The wick operating structure 12 of the illustrated embodiment may be so constructed that an operation lever for actuating a wick operating shaft may be finely operated to finely adjust the combustion operation of the oil burner with high accuracy. More particularly, the wick operating structure of the lever actuation type 12 includes a wick operating shaft 20 arranged so as to horizontally extend into the interior of the oil burner 10, which is connected at an inner end thereof to one end of an actuation arm 22. The actuation arm 22 is operatively connected at the other end thereof to a connecting plate 24 mounted on a wick holding cylinder 26 of the wick receiving cylinder construction 16 on which a wick 28 is held, resulting in the wick 28 being operatively connected to the wick operating shaft 20. Thus, when the wick operating shaft 20 is rotated in any direction, the wick 28 held on the wick holding cylinder 26 is vertically moved through the actuation arm 22 and connecting plate 24 toward the combustion position or fire-extinguishing position. In the illustrated embodiment, the wick operating shaft 20 may be arranged so as to extend a base plate 30 for the wick operating structure 12 and be supported through the base plate 30.

The wick operating structure 12 also includes an operation lever 32 formed into a substantially elongated plate-like shape and fitted on the wick operating shaft 20. In the illustrated embodiment, the lever 32 is mounted at an intermediate portion thereof on the shaft 20. The lever 32 is provided with or operatively connected to an operation knob 34 slidably fitted in an elongated aperture 36 formed at the base plate 30 so as to vertically extend. In the illustrated embodiment, the operation knob 34 is arranged at one end of the operation lever 32 and the operation lever 32 is fixedly fitted on the wick operating shaft 20. Thus, when the knob 34 is vertically moved along the aperture 36, the operation lever 32 may be rotated about the wick operating shaft 20, resulting in the shaft 20 being rotated together with the lever 32.

The operation lever 32 is also provided thereon with a drive pin 38 in a manner to horizontally project therefrom. In the illustrated embodiment, the drive pin 38 is arranged at the other end of the lever 32. Correspondingly, a plurality of drive levers 40 are arranged in proximity to the drive pin 38 and supported on a common support shaft 42 in a manner to overlap one another and be pivotally moved separate from one another about the support shaft 42 so as to be accessible to the drive pin 38. In the illustrated embodiment, three such drive levers 40 are provided.

Figure 2:
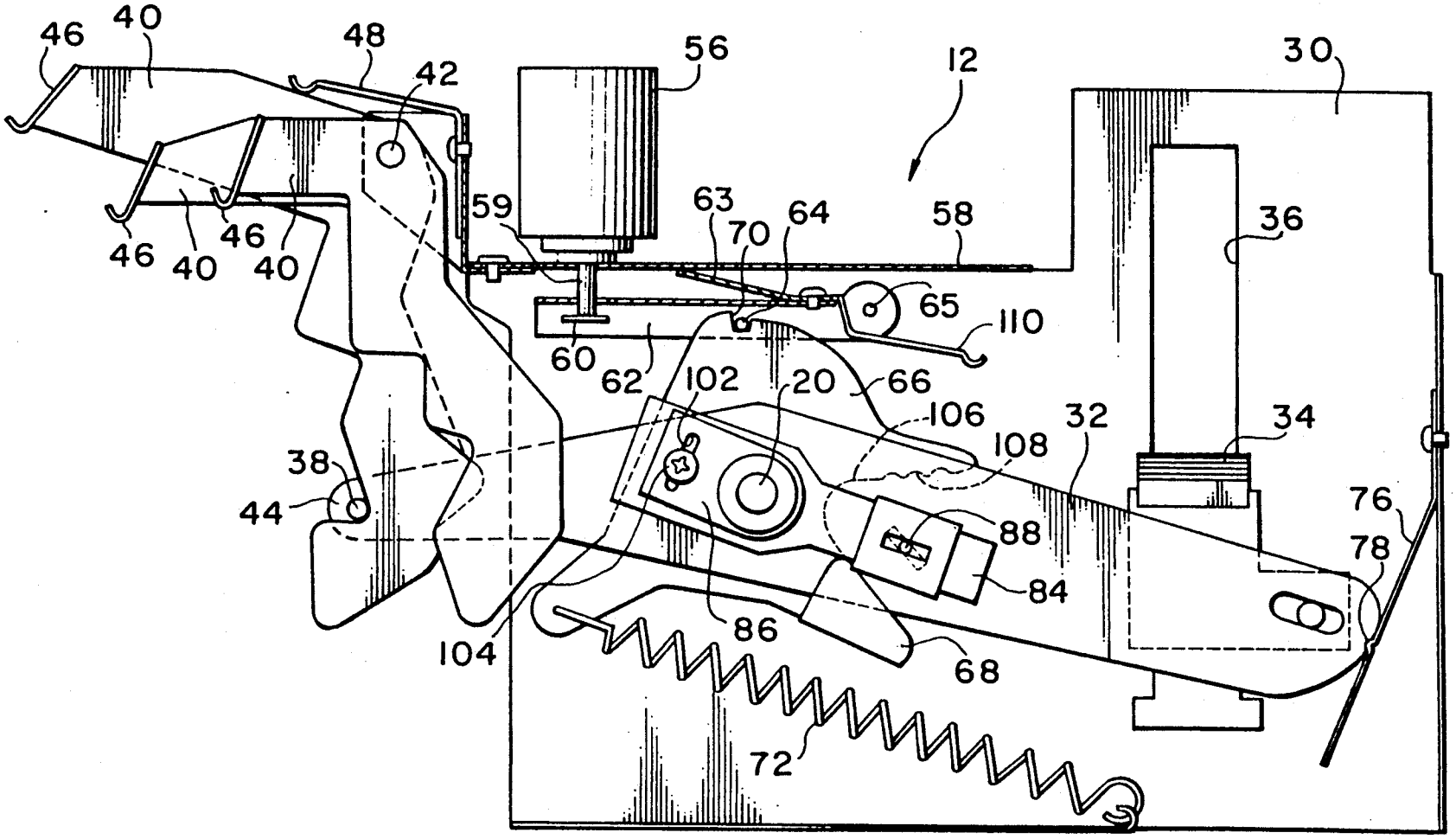
FIG. 2 is a front elevation view showing an embodiment of a wick operating structure of the lever actuation type according to the present invention.

The drive levers 40 each are formed with a V-shaped recess 44 adapted to be engaged with the drive pin 38 described below. In the illustrated embodiment, the recess 44 is arranged at one end of the drive lever 40. The V-shaped recess 44 is so positioned that its open end or inlet may be opposite to the drive pin 38 when the operation lever 32 is rotated to the combustion position or wick raised position. The recesses 44 of the drive levers 40 are formed into configurations different from one another so that the operation lever 32 is engaged with the respective drive levers 40 through the drive pin 38 and recesses 44 at positions different from one another little by little to vary the height or vertical position of the wick 28 little by little as desired. For this purpose, in the illustrated embodiment, the recesses 44 are so formed that dimensions of their inlets or open ends are the same, however, their bottoms are positionally or dimensionally different from one another as shown in FIG. 2. This may be accomplished by varying the positions of the bottoms of the V-shaped recesses 44 from one another in a vertical direction.

Figure 3:
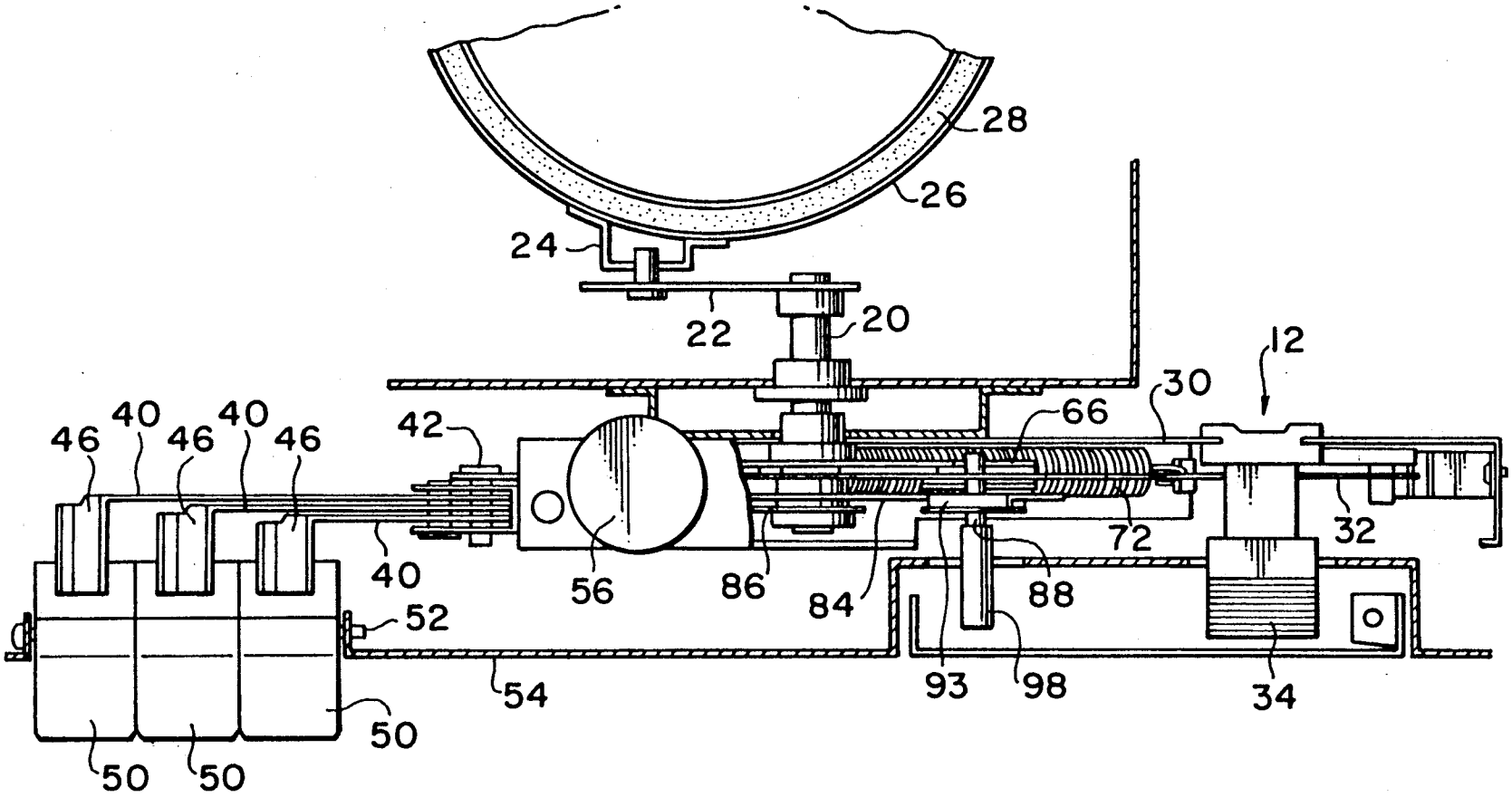
FIG. 3 is a plan view of the wick operating structure shown in FIG. 2.

The drive levers 40 each are formed at the other end thereof with an operation element 46, which may be formed by bending the other end of the lever 40 into an L-shape. The L-shaped operation elements 46 of the drive levers 40 are arranged at positions different from one another, as shown in FIGS. 2 and 3. The drive levers 40 each are constantly urged in a direction of separating the V-shaped recess 44 from the drive pin 38 or in a counterclockwise direction in FIG. 2 by gravity. Also, in the illustrated embodiment, they may be forcibly urged in the same direction and, for this purpose, a leaf spring 48 is provided so as to constantly force the drive levers 40 in the counterclockwise direction about the support shaft 42.

Figure 4:
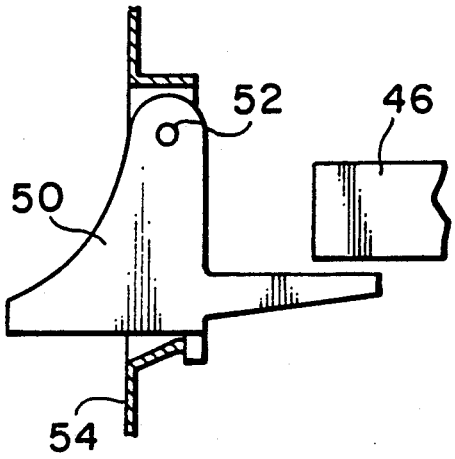
FIG. 4 is a schematic sectional view showing operative connection between an operation element and a control element.

The L-shaped operation elements 46 are operatively engaged with or connected to plate-like control elements 50 pivotally mounted on a shaft 52 supported on a front panel 54 of the oil burner 10 and arranged in a manner to positionally correspond to the operation elements 46, respectively, as shown in FIG. 4. Thus, any one of the control elements 50 is pivotally pushed down, it pivotally moves the L-shaped operation element 46 of the corresponding drive lever 40 to engage the V-shaped recess 44 of the lever 40 with the drive pin 38 of the operation lever 32, as shown in FIG. 2.

In the illustrated embodiment, an automatic fire-extinguishing device is provided which is adapted to carry out fire-extinguishing in an emergency such as an earthquake or the like to ensure safety of the oil burner. For this purpose, a vibration sensing weight 56 is pivotally movably arranged on a support 58 in the form of a plate mounted on the vertical base plate 30. The weight 56, as shown in FIG. 2, includes an actuation rod 59 downwardly extending therefrom, which is provided at a lower end thereof with an actuation plate 60. The actuation plate 60 is operatively connected to a stopper 62 mounted on the base plate 30 and forced toward its non-actuated or stationary position or toward the actuation plate 60 of the weight 56 by a leaf spring 63 interposedly arranged between the stopper 62 and the support plate 58, so that when the weight 56 falls down or tilts due to vibration, the plate 60 actuates or pushes up the stopper 62. In the illustrated embodiment, the stopper 62 is mounted through a shaft 65 on the base plate 30 so as to be pivotally movable about the shaft 65. The stopper 62 is provided with a retaining pin 64. The fire-extinguishing device also includes a drive plate 66 loosely fitted on the wick operating shaft 20 so as to be rotatable about the shaft 20 and provided with a connection element 68 for operatively connecting the drive plate 56 with the operation lever 32 therethrough. Also, the drive plate 66 is provided with an engagement portion or recess 70 which is adapted to be normally engaged with the retaining pin 64 to hold the drive plate 66 at its stationary position shown in FIG. 2. Further, a compression spring 72 is arranged which is connected at one end thereof to the drive plate 56 and at the other end thereof to the base plate 30, so that the drive plate 56 may be constantly urged in the fire-extinguishing direction or in the counterclockwise direction in FIG. 2. When the vibration sensing weight 56 falls down due to vibration, the actuation plates 60 actuates the stopper 62 to release the recess 70 of the drive plate 66 from the retaining pin 64 of the stopper 62, resulting in the drive plate 66 being rotated about the shaft 20 in the counterclockwise direction by the compression spring 72. This causes the connection element 68 of the drive plate 66 to be abutted against the operation lever 32 to rotate it in the counterclockwise direction or a wick lowered direction, leading to the fire-extinguishing.

Now, the manner of operation of the wick operating structure of the illustrated embodiment will be described hereinafter with reference to FIGS. 2 to 6.

Figure 5:
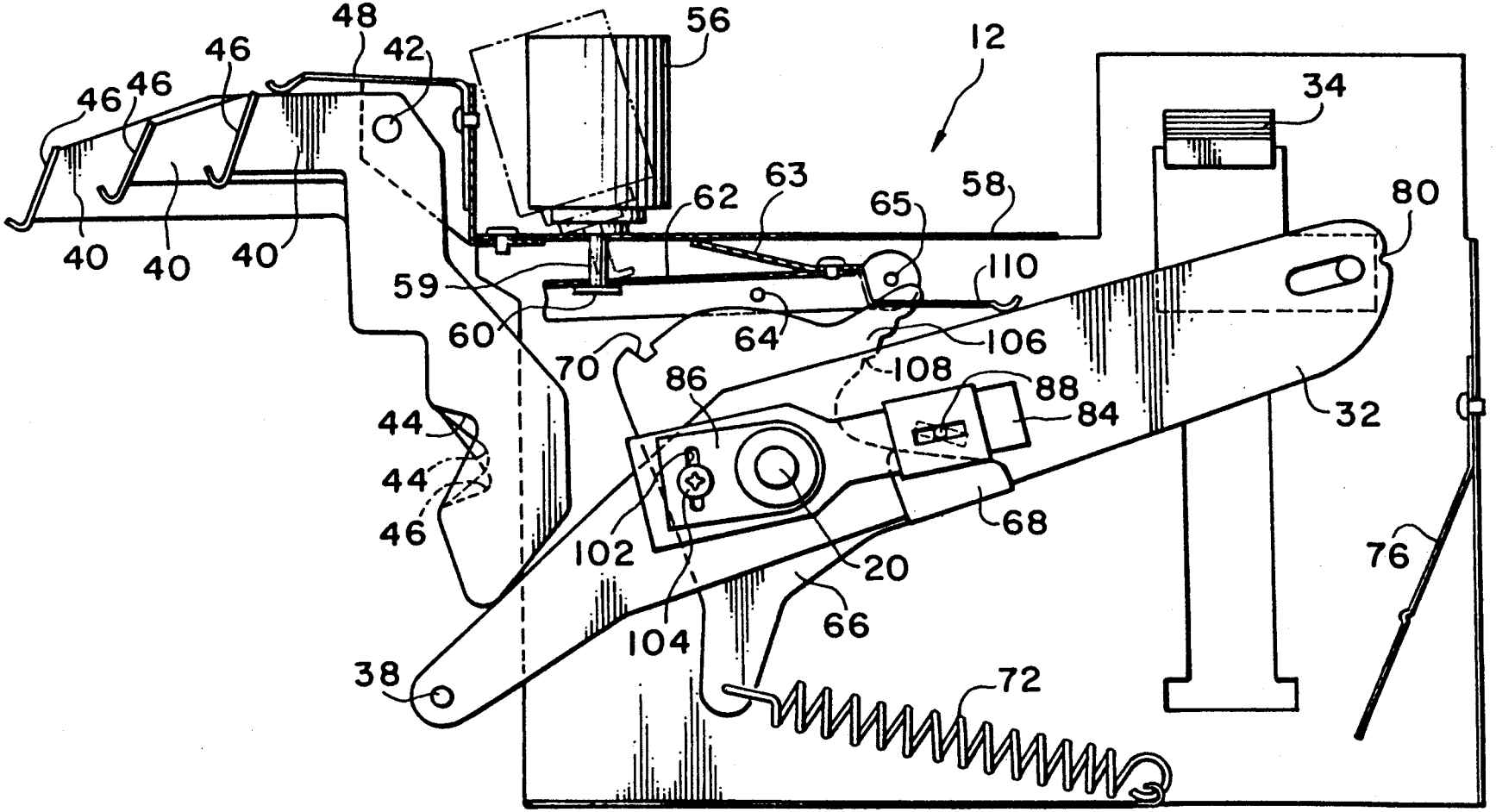
FIG. 5 is a front elevation view similar to FIG. 2 showing the fire-extinguishing operation through the actuation of a vibration sensing weight.
Figure 6:
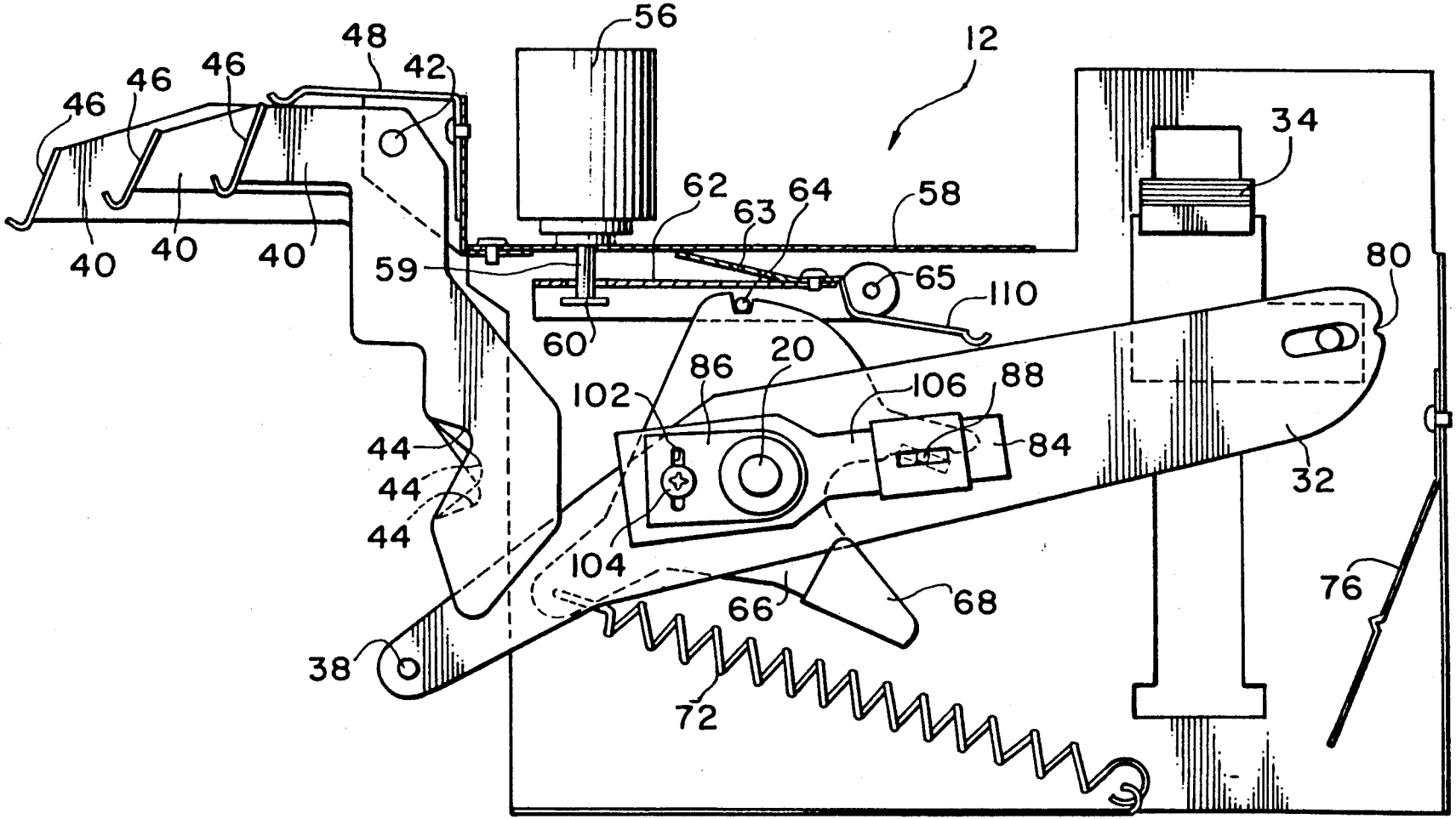
FIG. 6 is a front elevation view similar to FIG. 2 showing the fire-extinguishing operation through an operation lever.

First, the wick 28 is raised from the fire-extinguishing position shown in FIG. 5 or 6 to the combustion position shown in FIG. 2 through the operation of the operation knob 34. FIG. 5 shows the fire-extinguishing by the actuation of the automatic fire-extinguishing device and FIG. 6 shows the fire-extinguishing carried out through the operation knob 34. Now, the operation from the position of FIG. 5 to that of FIG. 2 will be described.

First, the operation knob 34 is lowered along the aperture 36 from the position of FIG. 5, so that the operation lever 32 may be pivotally moved in a clockwise direction in FIG. 5 to rotate the wick operating shaft 20 to the wick raised position or combustion position. Concurrently, the operation lever 32 rotates the drive plate 66 in the clockwise direction through the engagement with the connection element 68 against an elastic force of the compression spring 72, resulting in the recess 70 of the drive plate 66 being engaged with the retaining pin 64 of the stopper 62 to keep the drive plate 66 at the stationary position and reset the vibration sensing weight 56, as shown in FIG. 2.

Operation of the wick operating structure 12 from the position of FIG. 6 to that of FIG. 2 is carried out by merely lowering the operation knob 34. This results in the wick 28 being raised to the combustion position. Then, the ignition of the wick 28 is carried out according to any suitable procedure conventionally employed.

When it is required to vary the amount of combustion during the combustion operation, any desired one of the control elements 50 is pushed down, to thereby be pivotally moved about the shaft 52 of the front panel 54 to push up the corresponding L-shaped operation element 46. This results in the drive lever 40 held at a position separate from the drive pin 38 by gravity or the leaf spring 48 being pivotally moved about the support shaft 42 to move the V-shaped recess 44 to the drive pin 38. This causes the recess 44 to be engaged with the drive pin 38 through its open end or inlet of the recess 44 while pressing the drive pin 38 through a side surface of the recess 44, so that the operation lever 32 may be pivotally moved by a small distance, resulting in the drive pin 38 being positioned at the deepest portion or bottom of the V-shaped recess 44, as shown in FIG. 2.

In the illustrated embodiment, a plurality of the drive levers 40 are provided with the V-shaped recesses 44 different in configuration or shape from one another little by little in a manner to positionally vary the deepest portions or bottoms of the recesses 44 little by little, so that the actuation of the drive levers 40 causes the operation lever 32 to be pivotally moved by a small angle little by little during the combustion operation, thus, it will be noted that the combustion position of the wick 28 is finely varied or controlled as desired during the combustion operation.

When the control element 50 is released from the restraint, it returns to its original position by gravity, so that the drive lever 40 is pivotally moved about the support shaft 42 in the counterclockwise direction in FIG. 2 by gravity to disengage the V-shaped recess 44 from the drive pin 38. Even when the wall of the V-shaped recess 44 hatches on the drive pin 38, the leaf spring 48 forcedly rotates the drive lever 40 to release the recess from the drive pin.

As can be seen from the foregoing, the illustrated embodiment is so constructed that the operation lever may be finely varied during the combustion operation through the fine movement of the drive pin by the V-shaped recesses of the drive levers formed into configurations different from one another little by little, thus, it will be noted that the wick operating structure of the lever actuation type according to the present invention accurately accomplishes any desired variation in the amount of combustion during the combustion operation, in contrast with the conventional structure adapted to carry out a variation in combustion by directly manually adjusting the operation lever.

Also, in the illustrated embodiment, selection of any desired drive lever is readily carried out through the control elements arranged positionally corresponding to the drive levers, to thereby facilitate handling of the structure.

Figure 8:
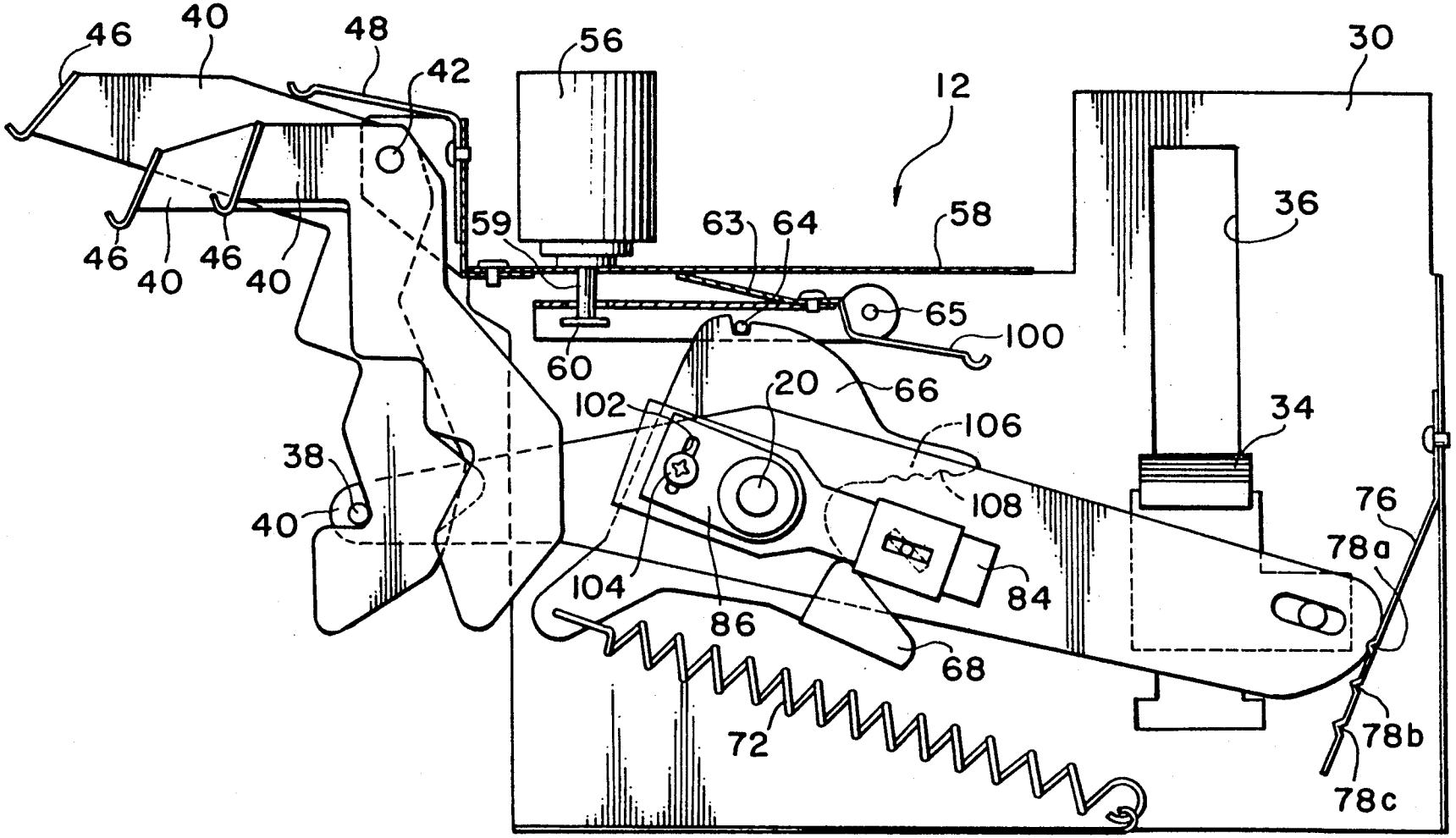
FIG. 8 is a front elevation view showing a modification of the wick operating structure shown in FIG. 2.

The wick operating structure of the illustrated embodiment may be constructed so as to effectively prevent the position of the wick from being suddenly varied during the combustion operation due to vibration or shock applied to the oil burner. For this purpose, as shown in FIGS. 1, 2, 5 and 6, a leaf spring 76 is arranged in a manner to be mounted at one end thereof on the base plate 30. The leaf spring 76 is adapted to be elastically contacted at a suitable portion thereof with the operation lever 32 to hold it stationary at the combustion position during the combustion operation. In the embodiment, the leaf spring 76 is adapted to be contacted with an end surface of the one end of the operation lever 32. The contacting of the leaf spring 76 with the lever 32 is started at or near the position of the operation lever 32 actuated to a degree sufficient to render combustion in the oil burner possible. The contacting is preferably started just before the operation lever 32 arrives at the above-described position. The leaf spring 76 may be provided with at least one projection 78 for the purpose of more positively holding the operation lever 32 stationary at the combustion position. In the illustrated embodiment, one such projection 78 is provided at the position on the leaf spring 76 which causes it to be contacted with the end surface of the operation lever 32 when the operation lever 32 is actuated to a degree sufficient to locate the wick at its minimum combustion position. However, the embodiment is not limited to such arrangement of the projection. Two or more such projections 78 may be provided. For example, as shown in FIG. 8, three such projections 78*a*, 78*b* and 78*c* may be formed at the leaf spring 76 at positions of the spring 76 corresponding to the minimum combustion position, intermediate combustion position and maximum combustion position of the operation lever 32, respectively.

Further, the operation lever 32 may be formed at its end surface with a depression 80 (FIG. 6) such as a cutout, a recess or the like which is adapted to fittedly engaged with the projection 78 to more securely hold the operation lever 32 at any combustion position during the combustion operation.

In the wick operating structure in which the leaf spring 76 is thus arranged, the downward movement of the operation knob 34 along the guide aperture 36 causes the knob 34 to push down the operation lever 32, so that the wick 28 may be raised to the position of rendering combustion in the oil burner possible, resulting in the end surface of the operation lever 32 starting to be contacted with the leaf spring 76. Then, the wick 28 is raised to its uppermost position while being forcedly contacted with the leaf spring 76 for the ignition. During the operation, an elastic force of the leaf spring 76 contacted with the lever 32 is directed to a center of pivotal movement of the operation lever 32 without being dispersed, resulting in the operation lever being positively held stationary at a desired combustion position with substantially greater power.

When the operation knob 34 is to be returned to the original position for the fire-extinguishing operation, the operation lever 32 is abutted against the leaf spring 76 and particularly the projection 78 of the leaf spring 76 to resist the wick lowering operation. Accordingly, the wick operating structure of the embodiment permits the combustion to be adjustable between the maximum combustion position and the minimum combustion position, so that undesirable lowering of the wick below the minimum combustion position leading to abnormal combustion may be effectively prevented during the combustion operation. The fire-extinguishing operation may be carried out by upwardly moving the operation knob 34 by a force overcoming the force at which the projection 78 presses the operation lever 32.

The structure shown in FIG. 8 permits combustion to be adjusted with higher accuracy.

In the construction described above, the leaf spring 76 forcedly presses the end of the operation lever 32 during the combustion operation, so that the operation lever 32 may be prevented from being moved due to vibration or shock applied thereto, resulting in eliminating any trouble which leads to a sudden variation in combustion. As described above, the conventional wick operating structure of the lever actuation type fails to adjust combustion because the amount of movement of the operation knob is limited to a reduced range. On the contrary, the embodiment of the present invention is so constructed that the leaf spring 76 is provided with the projection 78 corresponding to at least the minimum combustion position, accordingly, an operator is aware of undesired excessive lowering of the operation lever during the combustion operation, resulting in adjusting combustion within a normal combustion range.

Figure 7:
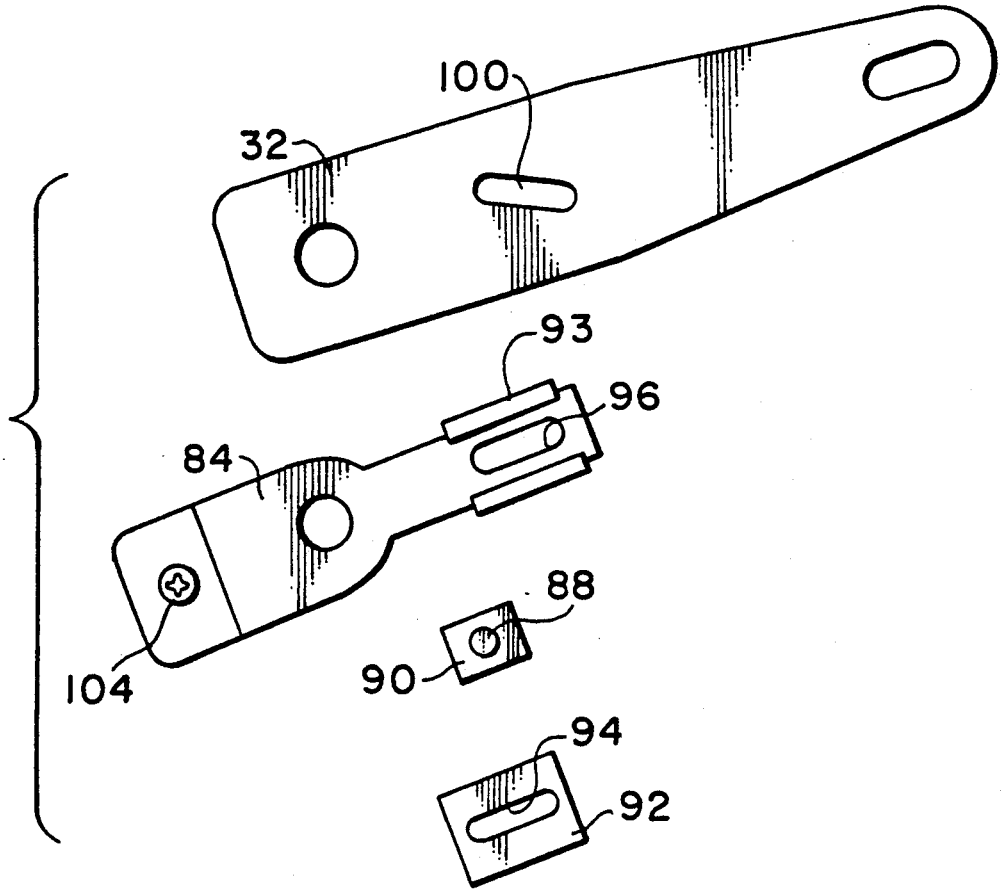
FIG. 7 is an exploded perspective view showing an operation lever and a connection lever.

Further, the wick operating structure of the illustrated embodiment may be constructed so as to adjust or vary a height or vertical position of the wick from the exterior of the oil burner without disassembling it. For this purpose, it includes a connection lever 84 loosely fitted on the wick operating shaft 20 so as to be rotated about it and an actuation lever 86 fixedly fitted on the wick operating shaft 20 so as to be rotated together with the wick operating shaft 20, so that the operation lever 32 is operatively connected through the connection lever 84 and actuation lever 86 to the wick operating shaft 20 for driving it. The connection lever 84 is provided with a slide pin 88 in a manner to be slidable on the lever 84. In the illustrated embodiment, as detailedly shown in FIG. 7, the slide pin 88 is mounted on a slide block 90 so as to laterally extend therethrough and a holding plate 92 is supported on the connection lever 84 through a holder 93 in such a manner that the slide block 90 is slidably interposed between the connection lever 84 and the holding plate 92. For this purpose, the holding plate 92 and connection lever 84 are formed with elongated apertures or slots 94 and 96, respectively, which extend in a longitudinal direction of the connection lever 84 for slidably guiding the slide pin 88 therealong. The holder 93 is provided at the connection lever 84 so as to cover the upper and lower sides of the holding plate 92. The slide pin 88 may be provided at an outer end thereof with a knob 98 (FIG. 3) for operating the slide pin 88. The operation lever 32 is formed with an elongated aperture or slot 100 for slidably inserting the slide pin 88 of the slide block 90 therethrough. The slot 100 is arranged so as to extend in a manner to be oblique by a predetermined angle with respect to the longitudinal direction of the operation lever 32, resulting in being oblique with respect to the direction of sliding of the slide pin 88.

The actuation lever 86 is fixedly connected to the connection lever 84 so that a positional relationship therebetween may be varied as desired. More particularly, the actuation lever 86 is formed with a slot 102 extending laterally with respect to the longitudinal direction thereof and preferably in a direction of pivotal movement thereof, through which a setscrew 104 is threaded into the connection lever 84 to positionally variably fix the actuation lever 86 with respect to the connecting lever 84. A relative positional variation between the connection lever 84 and the actuation lever 86 may be carried out by varying the connection lever 84 relative to the actuation lever 86 along the slot 102.

In the illustrated embodiment, the operative connection among the connection lever 84, actuation lever 86 and operation lever 32 is not limited to such a manner as described above. For example, the embodiment may be so modified that the connection between the operation lever 32 and the connection lever 84 is carried out by means of such a combination of a setscrew and a slot as described above and the connection between the connection lever 84 and the actuation lever 86 is carried out using such a combination of a slide pin and slots as described above.

The manner of operation of the above-described construction of the embodiment will be described.

When the operation knob 34 is pushed down, the operation lever 32 is pivotally moved about the wick operating shaft 20. This results in the connection lever 84 being pivotally moved because both are operatively connected through the engagement between the slide pin 88 and the slot 100 of the connection lever 32. Also, this leads to the pivotal movement of the actuation lever 86 because it is fixedly connected to the connection lever 84 by means of the setscrew 104. Accordingly, the actuation of the operation lever 32 causes the wick operating shaft 20 to be driven through the connection lever 84 and actuation lever 86 because the actuation lever 86 is fixedly fitted thereon as described above.

Thus, two operative connections are provided between the actuation lever 86 for directly driving the wick operating shaft 20 and the operation lever 32. In the illustrated embodiment, one of the connections comprises the slide pin 88 and the slot 100 and is so constructed that the direction of sliding of the slide pin 88 is oblique with respect to the slot 100. Accordingly, the sliding movement of the slide pin 88 along the slots 94 and 96 through the knob 98 causes it to be likewise slid along the oblique slot 100 of the operation lever 32 to carry out the pivotal movement of the connection lever 84 relative to the operation lever 32, leading to a variation in relative position between the operation lever 32 and connection lever 84. Thus, the movement of the slide pin 88 while keeping the operation lever 32 stationary causes the pivotal movement of the connection lever 84 and therefore the rotation of the wick operating shaft 20 through the actuation lever 86, resulting in a variation in height or vertical position of the wick. The other of the two operative connections includes the setscrew 104 and is so constructed that the looseness of the setscrew 104 permits the relative position between the connection lever 84 and the actuation lever 86 to be varied through the slot 102, resulting in the vertical position or height of the wick being also varied.

As can be seen from the foregoing, in the above-described construction of the illustrated embodiment, the operation of the knob 98 permits the relative position between the operation lever 32 and the connection lever 84 to be varied through the sliding movement of the slide pin 88 along the slot 100, so that the vertical position or height of the wick may be adjusted to an optimum level even when the operation lever 32 is located at the maximum combustion position. Once the vertical position of the wick is thus varied, the wick is constantly held at the same level for the same combustion unless it is further varied according to the above-described procedure.

As described above, in the conventional wick operating structure of the lever actuation type, an angle of pivotal movement of a wick operating shaft is set within a narrow range, so that even the pivotal movement of the operating shaft by the same angle often cause a variation in vertical position or height of a wick depending on the manner of arrangement of the wick in an oil burner. The illustrated embodiment eliminates such a problem because the wick can be set at an optimum vertical position through the movement of the slide pin 88.

When the position of the slide pin 88 is one-sided toward the wick raised position for a fresh wick, the adjustment of the slide pin 88 which is to be carried out when the wick is deteriorated is limited to a narrow range. However, the embodiment can accommodate itself to such a problem. More particularly, the connection lever 84 is operatively connected between the operation lever 32 and the actuation lever 86 and one of the operative connections between the connection lever 84 and the operation lever 32 and between the connection lever 84 and the actuation lever 86 comprises a combination of the slide pin 88 and slot 100 and the other operative connection comprises a combination of the setscrew 104 and slot 102. In such construction of the embodiment, the optimum vertical position of the wick is set in such a manner that the positional relationship between the slide pin 88 and the slot 100 is determined so as to set the wick 28 at its uppermost vertical position and then the setscrew 104 is loosened to move the actuation lever 86 relative to the connection lever 84 to move the wick operating shaft 20 to set the wick 28 at the optimum vertical position, followed by fastening of the setscrew 104 to carry out fixing between both levers 84 and 86. This results in the slide pin 88 being located at a position of causing the wick to be set at the lowermost combustion position when the operation lever 32 is pivotally moved toward the wick raised position, so that a range for the adjustment of the slide pin 88 which is to be carried out when the wick is deteriorated may be substantially increased.

Thus, the adjustment of vertical position of the wick required when the tip end of the wick is deteriorated is satisfactorily carried out by merely setting the slide pin 88 at its desired position through the knob 98, so that the subsequent actuation of the operation lever 32 permits the wick to be constantly set at the newly determined vertical position, resulting in the handling of the wick operating structure being highly improved and facilitated.

In the construction described above, it is possible to use the slide pin 88 as a stopper by abutting or contacting the slide pin 88 against or with the drive plate 66 at the fire-extinguishing position or wick lowered position to positively hold the wick operating shaft 20 at the wick lowered position. It has been found that when the operation lever 32 is violently operated, it often strikes against the drive plate 66 to move the slide pin 88, to thereby undesirably vary the fire-extinguishing position of the wick to a degree sufficient to significantly vary time required for the fire-extinguishing. Also, the oblique slot 100 often causes the slide pin 88 to be undesirably moved, to thereby vary the combustion position of the wick.

The illustrated embodiment may be constructed so as to eliminate the above-described problem. This may be accomplished by forming the above-described drive plate 66 into a specific configuration. More particularly, as shown in FIGS. 2, 5 and 6, a holding element 106 for selectively holding the slide pin 88 is arranged so as to permit the slide pin 88 to be abutted against the holding element 106, resulting in the pin 88 being held on the holding element when the operation lever 32 is moved to the vicinity of the wick lowered position or fire-extinguishing position. In the illustrated embodiment, the holding element 106 comprises a part of the drive plate 66 and the slide pin 88 is abutted at a distal or inner end thereof against an end surface of the drive plate 66 held stationary through the engagement between the retaining pin 64 of the stopper 62 and the recess 70 of the drive plate 66, when the operation lever 32 is moved to the vicinity of the wick lowered position or fire-extinguishing position. The drive plate 66 or holding element 106 is formed on its end surface contacted with the slide pin 88 with a plurality of depressions 108, so that the slide pin 88 is abutted against any one of the depressions 108 when the operation lever 32 is manually moved toward the fire-extinguishing position through the operation knob 34, to thereby interrupt the wick lowering operation by the operation lever 32.

As described above, the embodiment is so constructed that the slide pin 88 is abutted against the drive plate 66 at the fire-extinguishing position or at the vicinity thereof to carry out the fire-extinguish while keeping the height of the wick substantially constant, so that time required for the fire-extinguishing may be rendered substantially constant. Thus, the embodiment effectively eliminates a disadvantage that when the position of stopping of the operation lever 32 in the fire-extinguishing direction is set at the wick lowered position, the movement of the slide pin 88 causes the height of the wick at the fire-extinguishing position to be varied to a degree sufficient to vary time required for the fire-extinguishing. Also, the drive plate 66 is formed at the portion thereof abutted against the slide pin 88 with a plurality of the depressions 108 of which any one is engaged with the slide pin 88 during the fire-extinguishing operation, so that the undesirable movement of the slide pin 88 due to shock or the like applied thereto during the fire-extinguishing operation may be effectively prevented which leads to a variation in height of the wick at the combustion position.

The wick operating structure of the illustrated embodiment may be constructed so as to permit the vibration sensing weight 56 to be automatically reset at the fire-extinguishing position of the wick operating shaft. For this purpose, the wick operating structure may include a reset element 110 arranged between the stopper 62 and the operation lever 32 moved to the wick lowered position or fire-extinguishing position so that the operation lever 32 moved to the fire-extinguishing position actuates the reset element 110 to urge the stopper 62 to hold it at the non-actuated or stationary position, resulting in resetting the vibration sensing weight 56 through the engagement with the stopper 62. In the illustrated embodiment, the reset element 110 comprises a lever which is mounted at one end thereof on the stopper 62 and abutted at the other end thereof against the operation lever 32 moved to the fire-extinguishing position due to the actuation or falling-down of the vibration sensing weight 56, and when the operation lever 32 is moved to the fire-extinguishing position, it forcedly pushes up the reset lever 110 to urge the stopper 62 toward the actuation plate 60 of the vibration sensing weight 56, resulting in the stopper 62 pushing down the actuation plate 60, leading to the resetting of the weight.

Now, the manner of operation of such construction will be described with reference to FIGS. 2 and 5.

When the vibration sensing weight 56 falls down due to shock or vibration applied thereto as indicated at dashed lines in FIG. 5, the drive plate 66 is disengaged from the stopper 62 through the disengagement of the retaining pin 64 from the recess 70 against the leaf spring 63 to pivotally move the operation lever 32 in the fire-extinguishing position through the connection element 68 as shown in FIG. 5, so that the fire-extinguishing may be accomplished. This causes the operation lever 32 to forcibly abut against the reset lever 110 to forcibly move the stopper 62 toward the actuation plate 60 of the weight 56 tilting as indicated at dashed lines in FIG. 5, resulting in the stopper 62 pushing down the actuation plate 60. This leads to the resetting of the vibration sensing weight 56 as indicated at solid lines in FIG. 5.

Then, the operation knob 34 is downwardly moved to pivotally move the operation lever 32 in the combustion position as shown in FIG. 2, during which the operation lever 32 is engaged with the drive plate 66 through the connection element 68 to pivotally move the drive plate 66 against the compression spring 72 to the position at which the recess 70 is engaged with the retaining pin 64, resulting in the operation lever 32 being located at the combustion position as shown in FIG. 2. Thus, the operation lever is ready for being manually moved toward the wick lowered position for the fire-extinguishing as shown in FIG. 6 or the adjustment of combustion.

The engagement of the stopper 62 with the drive plate 66 is carried out by the elastic force of the leaf spring 63 arranged between the support plate 58 and the stopper 62. In general, such a leaf spring used for this purpose is adapted to exhibit a weak force. Accordingly, when the vibration sensing weight 56 falls down during the combustion operation by an earthquake or the like to actuate the actuation plate 60 of the weight 56, the stopper 62 is readily lifted against the leaf spring 63 to release the retaining pin 64 of the stopper 62 from the recess 70 of the drive plate 66, so that the drive plate 66 may be pivotally moved in the counterclockwise direction in FIG. 5 by the spring 72 to likewise pivotally move the operation lever 32 in the fire-extinguishing direction through the connection element 68, as described above.

When the stopper 62 is disengaged from the drive plate 66 due to the actuation of the vibration sensing weight 56, the leaf spring 63 acts to pivotally move the stopper 62. However, as will be apparent from the fact that the falling-down of the vibration sensing weight 56 causes the stopper 62 to be upwardly pivotally moved or lifted with ease against the leaf spring 63, the leaf spring 63 fails to exhibit an elastic force sufficient to raise up the vibration sensing weight 56.

In the wick operating structure of the embodiment, as described above, the reset lever 110 is attached to the stopper 62 and abutted against the operation lever 32 moved to the fire-extinguishing position, so that the operation lever 32 forcibly pivotally moves the stopper 62 through the reset lever 110 toward the actuation plate 60 of the vibration sensing weight 56, resulting in the vibration sensing weight 56 being readily and positively reset immediately after accomplishing the fire-extinguishing.

Also, during the combustion operation, the reset lever 110 is fully separated from the operation lever 32 as shown in FIG. 2, so that only the weak elastic force of the leaf spring 63 acts on the stopper 62. Thus, the falling-down of the vibration sensing weight 56 causes the stopper 62 to be positively actuated, resulting in the automatic fire-extinguishing device being effectively actuated. At this time, the return spring 72 pivotally moves the operation lever 32 through the drive plate 66 to the fire-extinguishing position, which then raises up the vibration sensing weight 56 through the reset lever 110 and stopper 62 simultaneous with the pivotal movement to the fire-extinguishing position. Thus, it will be noted that such construction eliminates a specific operation of resetting the vibration sensing weight.

Further, the construction can be realized in a simple manner because the operative connection between the reset lever 110 and the operation lever 32 is simply carried out by merely attaching the reset lever 110 to the stopper 62.

While the preferred embodiment of the invention has been described with a certain degree of particularity with reference to the drawings, obvious modifications and variations are possible in the light of the above teachings. It is therefore to be understood that within the scope of the appended claims, the invention may be practiced otherwise than specifically described.

What is claimed is:

1. A wick operating structure of the lever actuation type for an oil burner comprising:

a wick operating shaft rotatably arranged for vertically moving a wick due to its rotation;

an operation lever fitted on said wick operating shaft for rotating said wick operating shaft;

said operation lever being provided with a drive pin; and, a plurality of drive levers arranged in a manner to be pivotally moved independent from one another about a common support shaft so as to be accessible to said drive pin of said operation lever;

said drive levers each being provided with a V-shaped recess at a portion thereof opposite to said drive pin of said operation lever when said operation lever is pivotally moved to a wick raised position;

said V-shaped recesses of said drive levers being formed into configurations different from one another little by little to a degree sufficient to permit said operation lever to be pivotally moved little by little through alternate engagement of said drive pin with said V-shaped recesses of said drive levers to vary the vertical position of said wick little by little during the combustion operation.

2. A wick operating structure as defined in claim 1, wherein said operation lever is fixedly fitted on said wick operating shaft.

3. A wick operating structure as defined in claim 1, wherein said V-shaped recesses are different in depth from each other.

4. A wick operating structure as defined in claim 1, wherein said drive levers are operatively connected to control elements arranged at an exterior of said wick operating structure, respectively.

5. A wick operating structure as defined in claim 4, wherein said drive levers each are formed at an end thereof with an operation element through which said drive lever is operatively connected to said control element.

6. A wick operating structure as defined in claim 4, wherein said control elements are arranged on a front panel of the oil burner.

7. A wick operating structure as defined in claim 1 further comprising a leaf spring elastically contacted with said operation lever to hold it at the combustion position during the combustion operation. said leaf spring being so arranged that the contacting of said leaf spring with said operation lever is started at or near the position of said operation lever actuated to a degree sufficient to render combustion in oil burner possible.

8. A wick operating structure as defined in claim 7, wherein said contacting is started just before said operation lever arrives at said position.

9. A wick operating structure as defined in claim 7, wherein said operation lever is contacted at an end surface thereof with said leaf spring.

10. A wick operating structure as defined in claim 9, wherein said leaf spring is provided with at least one projection arranged so as to be engaged with said end surface of said operation lever at at least the minimum combustion position of said operation lever.

11. A wick operating structure as defined in claim 10, said operation lever is formed with a depression which is fittedly engaged with said projection of said leaf spring.

12. A wick operating structure as defined in claim 9, wherein said leaf spring is provided with three projections arranged so as to be engaged with said end surface of said operation lever at the minimum, intermediate and maximum combustion positions of said operation lever.

13. A wick operating structure as defined in claim 12, said operation lever is formed with a depression which is alternatively engaged with said projections of said leaf spring.

14. A wick operating structure as defined in claim 1 further comprising:

a connection lever loosely fitted on said wick operating shaft so as to be rotated about said wick operating shaft;

a drive lever fixedly fitted on said wick operating shaft;

said operation lever being loosely fitted on said wick operating shaft so as to be rotatable about said wick operating shaft; and two operative connection means for carrying out the operative connection between said operation lever and said connection lever constituting a first lever combination together and the operative connection between said connection lever and said drive lever constituting a second lever combination together, respectively;

one of said two operative connection means comprising a combination of a slide pin slidably provided on one lever of said first lever combination and a slot formed at the other lever of said first lever combination for fitting said slide pin therein;

said slide pin being arranged so as to be operable from the exterior of the oil burner;

the other of said two operative connection means comprising a setscrew for connecting said two levers of said second lever combination to each other;

said slot in said one operative connection being formed so as to be oblique with respect to a direction of sliding of said slide pin;

said setscrew of said the other operative connection being fastened in a manner to relatively vary the position between said second levers of said second lever combination.

15. A wick operating structure as defined in claim 14, wherein said the other operative connection means further comprising a slot formed at one of said two levers of said second lever combination for varying a position of said setscrew along said slot to relatively vary said position between said two levers of said second lever combination.

16. A wick operating structure as defined in claim 14, wherein said one operative connection means is for connecting said operation lever to said connection lever and said the other operative connection means is for connecting said connection lever to said drive lever.

17. A wick operating structure as defined in claim 14 further comprising a holding element against which said slide pin is abutted when said operation lever is moved to the wick lowered position or the vicinity of the wick lowered position;

said holding element being formed at a portion thereof abutted against said drive pin with a plurality of depressions of any one securely holds said drive pin therein.

18. A wick operating structure as defined in claim 17, wherein said holding member is abutted on an end surface thereof with said slide pin.

19. A wick operating structure as defined in claim 18, wherein said holding element comprises a part of a drive plate for an automatic fire-extinguishing device.

20. A wick operating structure as defined in claim 17, wherein said holding element comprises a part of a drive plate for an automatic fire-extinguishing device.

21. A wick operating structure as defined in claim 1 further comprising an automatic fire-extinguishing device and a reset element;

said automatic fire-extinguishing device comprising a vibration sensing weight pivotally movably arranged on a support mounted on the oil burner, a stopper operatively connected to said vibration sensing weight so as to be actuated due to the falling-down of said vibration sensing weight, a leaf spring arranged between said support and said stopper so as to constantly urge said stopper toward its non-actuated position, a drive plate loosely fitted on said wick operating shaft so as to be rotatable about said wick operating shaft and normally engaged with said stopper to be held stationary, as well as operatively connected to said operation lever so as to actuate said operation lever in the fire-extinguishing direction due to disengagement from said stopper, and a compression spring connected to said drive plate so as to constantly urge said drive plate in the fire-extinguishing direction;

said reset element being arranged between said stopper and said operation lever and actuated by said operation lever moved to the fire-extinguishing position;

actuation of said reset element urging said stopper to hold said stopper at the non-actuated position, to thereby reset said vibration sensing weight through the engagement with said stopper.

22. A wick operating structure as defined in claim 21, wherein said reset element is in the form of a lever.

23. A wick operating structure as defined in claim 21, wherein said reset lever is actuated by said operation lever moved to the fire-extinguishing position due to the actuation of said vibration sensing weight.

24. A wick operating structure of the lever actuation type for an oil burner comprising:

a wick operating shaft rotatably arranged for vertically moving a wick due to its rotation;

an operation lever fitted on said wick operating shaft for rotating said wick operating shaft; and, a leaf spring elastically contacted with said operation lever to hold it at a combustion position at which it is actuated to a degree sufficient to render combustion in the oil burner possible;

said leaf spring being so arranged that the contacting of said leaf spring with said lever is started at or near said combustion position and the elastic force of said contact prevents undesired movement of said lever due to shock or vibration applied thereto during the combustion operation.

25. A wick operating structure as defined in claim 24, wherein said contacting is started just before said operation lever arrives at said position.

26. A wick operating structure as defined in claim 24, wherein said operation lever is contacted at an end surface thereof with said leaf spring.

27. A wick operating structure as defined in claim 26, wherein said leaf spring is provided with at least one projection arranged so as to be engaged with said end surface of said operation lever at at least the minimum combustion position of said operation lever.

28. A wick operating structure as defined in claim 27, wherein said operation lever is formed with a depression which is fittedly engaged with said projection of said leaf spring.

29. A wick operation structure of the lever actuation type for an oil burner, comprising:

a wick operating shaft rotatably arranged for vertically moving a wick due to its rotation;

an operation lever loosely fitted on said wick operating shaft so as to be rotatable about said wick operating shaft;

a connection lever loosely fitted on said wick operating shaft so as to be rotated about said wick operating shaft;

a drive lever fixedly fitted on said wick operating shaft; and two operating connection means for carrying out the operative connection between said operation lever and said connection lever and the operative connection between said connection lever and said drive lever, respectively, said operation lever and said connection lever constituting a first lever combination in cooperation with each other, and said connection lever and said drive lever constituting a second lever combination in cooperation with each other;

one of said two operative connection means comprising a combination of a slide pin slidably provided on one lever of said first lever combination and a slot formed at the other lever of said first lever combination for fitting said slide pin therein;

said slide pin being arranged so as to be operable from the exterior of the oil burner;

the other of said two operative connection means comprising a setscrew for connecting said two levers of said second lever combination to each other;

said slot in said one operative connection being formed so as to be oblique with respect to a direction of sliding of said slide pin;

said setscrew of said the other operative connection being fastened in a manner to relatively vary the position between said second levers of said second lever combination.

30. A wick operating structure as defined in claim 29, wherein said the other operative connection means further comprising a slot formed at one of said two levers of said second lever combination for varying a position of said setscrew along said slot to relatively vary said position between said two levers of said second lever combination.

31. A wick operating structure as defined in claim 29, wherein said one operative connection means is for connecting said operation lever to said connection lever and said the other operative connection means is for connecting said connection lever to said drive lever said drive lever to said drive lever.

32. A wick operating structure of the lever actuation type for an oil burner, comprising:

a wick operating shaft rotatably arranged for vertically moving a wick due to its rotation;

an operation lever loosely fitted on said wick operating shaft so as to be rotatable about said wick operating shaft;

a connection lever loosely fitted on said wick operating shaft so as to be rotated about said wick operating shaft;

a drive lever fixedly fitted on said wick operating shaft;

two operative connection means for carrying out the operative connection between said operation lever and said connection lever and the operative connection between said connection lever and said drive lever, respectively, said operation lever and said connection lever constituting a first lever combination in cooperation with each other, and said connection lever and said drive lever constituting a second lever combination in cooperation with each other;

one of said two operative connection means comprising a combination of a slide pin slidably provided on one lever of said first lever combination and a slot formed at the other lever of said first lever combination for fitting said slide pin therein;

said slide pin being arranged so as to be operable from the exterior of the oil burner;

the other of said two operative connection means comprising a setscrew for connecting said two levers of said second lever combination to each other;

said slot in said one operative connection being formed so as to be oblique with respect to a direction of sliding of said slide pin;

said setscrew of said the other operative connection being fastened in a manner to relatively vary the position between said second levers of said second lever combination; and a holding element against which said slide pin is abutted when said operation lever is moved to the wick lowered position or the vicinity of the wick lowered position;

said holding element being formed at a portion thereof abutted against said drive pin with a plurality of depressions of which any one securely holds said drive pin therein. therein.

33. A wick operating structure as defined in claim 32, wherein said holding member is abutted on an end surface thereof with said slide pin.

34. A wick operating structure as defined in claim 33, wherein said holding element comprises a part of a drive plate for an automatic fire-extinguishing device.

35. A wick operating structure as defined in claim 32, wherein said holding element comprises a part of a drive plate for an automatic fire-extinguishing device.

36. A wick operating structure of the lever actuation type for an oil burner, comprising:

a wick operating shaft rotatably arranged for vertically moving a wick due to its rotation;

an operation lever loosely fitted on said wick operating shaft so as to be rotatable about said wick operating shaft;

an automatic fire-extinguishing device comprising a vibration sensing weight pivotally movably arranged on a support mounted on the oil burner, a stopper operatively connected to said vibration sensing weight so as to be actuated due to the falling-down of said vibration sensing weight, a leaf spring arranged between said support and said stopper so as to constantly urge said stopper toward its non-actuated position, a drive plate loosely fitted on said wick operating shaft so as to be rotatable about said wick operating shaft and normally engaged with said stopper to be held stationary, as well as operatively connected to said operation lever so as to actuate said operation lever in the fire-extinguishing direction due to disengagement from said stopper, and a compression spring connected to said drive plate so as to constantly urge said drive plate in the fire-extinguishing direction;

a reset element arranged between said stopper and said operation lever so as to be actuated by said operation lever moved to the fire-extinguishing position;

actuation of said reset element urging said stopper to hold said stopper at the non-actuated position, to thereby reset said vibration sensing weight through the engagement with said stopper.

37. A wick operating structure as defined in claim 36, wherein said reset element is in the form of a lever.

* * * * *

UNITED STATES PATENT AND TRADEMARK OFFICE

CERTIFICATE OF CORRECTION

PATENT NO. : 5,030,085

DATED : July 9, 1991

INVENTOR(S) : Yamada, et al.

It is certified that error appears in the above-identified patent and that said Letters Patent is hereby corrected as shown below:

Column 19, lines 9-10, delete "said drive lever to said drive lever"

Column 20, line 6, delete the second occurrence of "therein."

Signed and Sealed this

Twentieth Day of October, 1992

*Attest:*

DOUGLAS B. COMER

*Attesting Officer*

*Acting Commissioner of Patents and Trademarks*